US009566690B2

(12) United States Patent
Petersen

(10) Patent No.: US 9,566,690 B2
(45) Date of Patent: Feb. 14, 2017

(54) SANDPAPER WITH NON-SLIP COATING LAYER

(71) Applicant: 3M INNOVATIVE PROPERTIES COMPANY, St. Paul, MN (US)

(72) Inventor: John G. Petersen, Center City, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 15/172,597

(22) Filed: Jun. 3, 2016

(65) Prior Publication Data

US 2016/0271756 A1 Sep. 22, 2016

Related U.S. Application Data

(60) Continuation of application No. 14/153,762, filed on Jan. 13, 2014, now Pat. No. 9,381,619, which is a division of application No. 12/484,605, filed on Jun. 15, 2009, now Pat. No. 8,662,962.

(60) Provisional application No. 61/076,821, filed on Jun. 30, 2008.

(51) Int. Cl.

| | |
|---|---|
| ***B24D 11/02*** | (2006.01) |
| *B24B 37/24* | (2012.01) |
| *B24B 37/22* | (2012.01) |

(52) U.S. Cl.

CPC ..... *B24D 11/02* (2013.01); *B24B 37/22* (2013.01); *B24B 37/245* (2013.01)

(58) Field of Classification Search

CPC ..... B24B 37/042; B24B 37/245; B24B 37/22; B24D 11/02

See application file for complete search history.

(56) References Cited

U.S. PATENT DOCUMENTS

| | | | |
|---|---|---|---|
| 3,136,614 | A | 6/1964 | Kuzmick |
| 3,229,425 | A | 1/1966 | Homeyer |
| 3,306,718 | A | 2/1967 | Chapin |
| 3,813,231 | A | 5/1974 | Gilbert et al. |
| 3,875,703 | A | 4/1975 | Clemente |
| 4,035,961 | A | 7/1977 | Pemrick et al. |
| 4,163,647 | A | 8/1979 | Swiatek |
| 4,240,807 | A | 12/1980 | Kronzer |
| 4,331,453 | A | 5/1982 | Dau et al. |
| 5,109,638 | A | 5/1992 | Kime, Jr. |
| 5,436,063 | A | 7/1995 | Follett |
| D372,111 | S | 7/1996 | Zeigler |
| 5,578,095 | A | 11/1996 | Bland et al. |
| 5,804,610 | A | 9/1998 | Hamer et al. |
| 5,834,109 | A | 11/1998 | Follett et al. |
| 5,849,646 | A | 12/1998 | Stout et al. |
| 5,984,989 | A | 11/1999 | Davison et al. |

(Continued)

FOREIGN PATENT DOCUMENTS

| | | |
|---|---|---|
| WO | WO 95/03156 | 2/1995 |

OTHER PUBLICATIONS

International Search Report for PCT/US2009/048646, prepared by the Korean Intellectual Property Office, mailed Feb. 17, 2010.

*Primary Examiner* — Timothy V Eley

(57) ABSTRACT

A sheet of sandpaper includes a backing layer having opposed first and second major surfaces, an adhesive make coat on the first major surface, abrasive particles at least partially embedded in the make coat, thereby defining an abrasive surface, and a non-slip coating layer on the second major surface. Methods of making and using such sandpaper are also provided.

17 Claims, 1 Drawing Sheet

(56) References Cited

U.S. PATENT DOCUMENTS

| | | | |
|---|---|---|---|
| 6,007,591 | A | 12/1999 | Watanabe |
| 6,294,249 | B1 | 9/2001 | Hamer et al. |
| 6,383,064 | B1 | 5/2002 | Eggert et al. |
| 6,432,549 | B1 | 8/2002 | Kronzer |
| 6,613,113 | B2 | 9/2003 | Minick et al. |
| 6,677,030 | B2 | 1/2004 | Thakkar et al. |
| 6,928,794 | B2 | 8/2005 | Hamer et al. |
| D526,180 | S | 8/2006 | Holden |
| 7,235,114 | B1 | 6/2007 | Minick et al. |
| 7,285,146 | B2 | 10/2007 | Petersen |
| 7,329,171 | B2 | 2/2008 | Goetz |
| 2007/0243802 | A1 | 10/2007 | Petersen et al. |
| 2009/0035519 | A1 | 2/2009 | Gaeta et al. |

SANDPAPER WITH NON-SLIP COATING LAYER

BACKGROUND

The present invention relates generally to abrasive articles for abrading a work surface such as, for example, flexible sheet-like abrasive articles.

Sheet-like abrasive articles are commonly used in a variety of sanding operations including, for example, hand sanding of wooden surfaces. In hand sanding, the user holds the abrasive article directly in his or her hand and moves the abrasive article across the work surface. Sanding by hand can, of course, be an arduous task.

Sheet-like abrasive articles include, for example, conventional sandpaper. Conventional sandpaper is typically produced by affixing abrasive material to a relatively thin, generally non-extensible, non-resilient, non-porous backing (e.g., paper). The thin, flat, slippery nature of conventional sandpaper backing materials makes conventional sandpaper difficult to grasp, hold, and maneuver. Because of the slippery nature of conventional sandpaper, to hold a sheet of sandpaper securely, a user will grasp the sheet of sandpaper between his or her thumb and one or more of his or her remaining fingers. Holding the sandpaper in this manner is uncomfortable, can lead to muscle cramps and fatigue, and is difficult to maintain for an extended period of time. In addition, the thumb is typically in contact with the abrasive surface of the sandpaper, which can irritate or damage the skin. Also, because the thumb is positioned between the sandpaper and the work surface, grasping the sandpaper in this manner also interferes with the sanding operation. That is, due to the position of the thumb, a portion of the sandpaper abrasive surface is lifted away from the work surface during sanding. Because the lifted portion is not in contact with the work surface, the full sanding surface of the sandpaper is not utilized, and the effectiveness of the sandpaper is, therefore, diminished.

During hand sanding, a user often applies pressure to the sandpaper using his or her fingertips. Because of the thin nature of the backing materials used in conventional sandpaper, the finger pressure is concentrated in the regions where the finger pressure is applied. This, in turn, causes the sandpaper to wear and/or load unevenly, and produces an uneven sanding pattern on the work surface.

Conventional sandpaper is typically sold in standard size sheets, such as 9×11 inch sheets. To make sandpaper easier to use, users often fold the sandpaper, thereby producing smaller sheets that are easier to handle. Folding the sandpaper, however, produces a jagged edge, and also weakens the sandpaper along the fold line. During the rigors of sanding, the weakened fold line may tear, thereby resulting in premature failure of the sandpaper.

Various attempts have been made to provide abrasive articles that make hand sanding easier and/or more comfortable. U.S. Design Pat. No. Des. 372,111 (Zeigler), for example, discloses a combined glove and sandpaper. U.S. Design Pat. No. Des. 526,180 (Holden) discloses a sandpaper glove. Other attempts to produce abrasive articles that are more comfortable are disclosed in U.S. Pat. No. 6,613,113 (Minick et al.), U.S. Pat. No. 7,285,146 (Petersen), U.S. Pat. No. 7,235,114 (Minick et al.), and U.S. Patent Publication 2007/0243802 (Petersen et al.), each of which is assigned to the same assignee as the present invention.

U.S. Pat. No. 3,813,231 (Gilbert et. al.) discloses a flexible abrasive sheet including a backing of a copolymer of ethylene and acrylic acid having a melt index as determined by ASTM Test No. D1238-57T of from about 10 up to about 50 and contains from about 15 up to about 20 percent polymerized acrylic acid based on the weight of the copolymer, and an abrasive grit partially embedded in the ethylene-acrylic acid copolymer backing.

U.S. Pat. No. 4,240,807 (Kronzer) discloses a backing material for use in fabricating flexible abrasive sheets. The backing material comprises a flexible web substrate preferably of tough impregnated paper, having on one surface a heat-activatable binder coating which is a non-tacky solid at ambient temperatures and which coating when heated to a temperature insufficient to thermally degrade the substrate is softened and converted to a viscous fluid condition so that when abrasive grit is deposited on the softened coating and electrostatically aligned, the grit by virtue of its weight alone, i.e., by gravity, will sink into the coating to a depth which provides a firm bond with the coating after the heat is removed and the coating resets to its solid non-tacky state.

SUMMARY

The industry is always seeking improved abrasive articles, such as sandpaper, that are easier and more comfortable to use, more durable, easier and less expensive to produce, and have the desired performance attributes as abrasive articles. It would be desirable to provide sandpaper that has a non-slip surface that provides improved handling, and is therefore easy and comfortable to use, is easy and inexpensive to make, has improved cut, has improved durability, and produces finer scratches than a comparable sheet of sandpaper.

The present invention provides a sheet of sandpaper comprising a backing layer having opposed first and second major surfaces, an adhesive make coat on the first major surface, abrasive particles at least partially embedded in the make coat, thereby defining an abrasive surface, and a non-slip coating layer on the second major surface.

In one embodiment, the non-slip coating layer may be an elastomer. In other aspects, the non-slip coating layer may be tacky or non-tacky. In yet other aspects, the non-slip coating layer may be continuous or discontinuous, it may be clear, and it may define a generally planar (i.e., smooth) outer surface, or the non-slip coating layer may include a textured or patterned outer surface, which may be uniformly textured or have a varying surface texture.

In one embodiment, the non-slip coating layer may be a material selected from the group consisting of natural rubber, synthetic rubber, thermoplastic elastomers, thermoplastic vulcanizates, urethanes, acrylics, thermoplastic olefins, and combinations thereof. In a more specific embodiment, the non-slip coating layer may comprise rubber and tackifier. In an even more specific embodiment, the non-slip coating layer may comprise at least about 70 percent rubber and no greater than about 30 percent tackifier. In one embodiment, the rubber may comprise styrene-isoprene-styrene (SIS) block copolymer.

In another embodiment, the non-slip coating layer may comprise an acrylic polymer coating, or a repositionable pressure sensitive adhesive. In a more specific aspect, the non-slip coating layer may have an average tack level, as measured by ASTM D2979-88 (Standard Test Method for Tack of Pressure-Sensitive Adhesives Using an Inverted Probe Machine) using a ten (10) second dwell time, and a probe removal speed of one (1) centimeter/second (cm/s) of no greater than about 200 grams, no greater than about 250 grams, no greater than about 300 grams, and no greater than about 350 grams.

In another aspect, the non-slip coating layer, when bonded to itself, may have an adhesive strength that is less than the two-bond adhesive strength (i.e., the adhesive strength of the non-slip coating layer to the backing layer), such that the non-slip coating layer does not separate from the backing layer when the non-slip coating layer is separated from itself. In another aspect, the non-slip coating layer, when bonded to itself, may have an adhesion level that is less than the cohesive strength of the non-slip coating layer, such that the non-slip coating layer is not damaged when the non-slip coating layer is separated from itself.

In more specific aspects, the non-slip coating layer may comprise rubber having a thickness of about 10 mils to about 30 mils (254 to 762 micrometers), or the non-slip coating layer may comprise a low tack acrylic polymer coating or a repositionable pressure sensitive adhesive having a thickness of about 0.05 mils to about 3 mils (1.3 to 76 micrometers).

In another aspect, the non-slip coating layer may have an average peak static coefficient of friction of at least about 1 gram, at least about 1.25 grams, or at least about 1.5 grams, and/or an average kinetic coefficient of friction of at least about 0.75 grams, at least about 1 grams, and at least about 1.25 grams when measured according to ASTM D 1894-08 (Standard Test Method for Static and Kinetic Coefficients of Friction of Plastic Film and Sheeting) at 23° C. using an IMASS slip/peel tester (SP2000, commercially available from Instrumentors Inc., Strongsville, Ohio).

In various embodiments, the backing layer may be formed of a paper having a weight ranging from an A weight to a C weight, a cloth material, or a film, such as a polymeric film.

In other embodiments, the make coat may be selected from the group consisting of phenolic resins, aminoplast resins having pendant $\alpha,\beta$-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorene-modified epoxy resins, and combinations thereof.

In other embodiments, the sandpaper has opposed top and bottom edges, and left and right side edges, and the distance from the top edge to the bottom edge may range from about 10 inches to about 12 inches, and the distance from the left side edge to the right side edge may range from about 8 inches to about 10 inches. In other embodiments, the distance from the top edge to the bottom edges may range from about 8 to about 10 inches, and the distance from the left side edge to the right side edge may range from about 3 to about 4 inches, or from about 5 to about 6 inches.

In yet another aspect, the present invention provides a method of making a sheet of sandpaper having a non-slip coating layer by hot melt coating, comprising the steps of providing a paper backing layer having opposed first and second major surfaces, coating an adhesive make coat on the first major surface, at least partially embedding abrasive particles in the make coat, thereby forming an abrasive surface, providing a liquid hot melt pressure sensitive adhesive, coating the hot melt pressure sensitive adhesive on the second major surface, and curing (for example, using UV radiation) the hot melt pressure sensitive adhesive, thereby reducing the level of tack of the hot melt pressure sensitive adhesive to the desired level to form the non-slip coating layer.

In a specific embodiment, the present invention provides a sheet of sandpaper for hand sanding a work surface comprising a paper backing layer having opposed first and second major surfaces, an adhesive make coat on the backing layer first major surface, abrasive particles at least partially embedded in the adhesive make coat, thereby defining an abrasive surface, and a non-slip coating layer on the backing layer second major surface consisting essentially of an acrylic polymer coating having a low level of tackiness, wherein the non-slip coating layer has a thickness of no greater than about 2 mils.

The present invention also provides a method of hand sanding a work surface comprising the steps of providing a sheet of sandpaper including a non-slip coating layer as defined above, manually engaging the non-slip coating layer with at least one of a hand and a manually operated tool, and manually moving the sandpaper in a plurality of directions over the work surface.

In another specific embodiment, the present invention provides a sheet of sandpaper consisting of a paper backing layer having opposed first and second major surfaces, an adhesive make coat on at least one of the first and second major surfaces, abrasive particles at least partially embedded in the make coat, thereby defining an abrasive surface, and a non-slip coating layer on the major surface opposite the make coat. The non-slip coating layer may be, for example, an elastomer, an acrylic polymer, or a repositionable adhesive.

Advantages of certain embodiments of the present invention include providing sandpaper having a non-slip coating layer that makes the sandpaper easier and more comfortable to use than conventional sandpaper. In addition, making the non-slip coating layer is relatively simple and inexpensive, and does not otherwise affect the desirable performance attributes of the abrasive article. Additional advantages may include improved durability, improved flexibility, improved moisture resistance, and improved grip and hand appeal during use.

BRIEF DESCRIPTION OF THE DRAWINGS

The present invention will be further described with reference to the accompanying drawings, in which.

DETAILED DESCRIPTION

Figure 1:
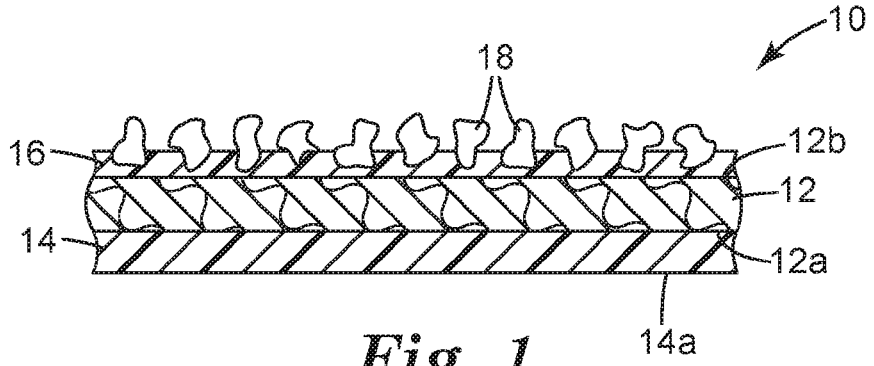
FIG. 1 is a cross sectional view of a sheet of sandpaper according to the invention.

Referring now to the drawings, FIG. 1 shows a cross-section of a sheet-like abrasive article 10, such as a sheet of sandpaper, comprising a flexible backing layer 12 having opposed first 12*a* and second 12*b* major surfaces, a flexible non-slip coating layer 14 on the backing layer first major surface 12*a*, an adhesive make coat layer 16 on the backing layer second major surface 12*b*, and a plurality of abrasive particles 18 at least partially embedded in the make coat layer 16. The abrasive article 10 may be provided in, for example, a stack of individual sheets, or in roll form, wherein the abrasive article 10 may have an indefinite length.

As used herein, the expression "sheet-like" refers generally to the broad, thin, flexible nature of the abrasive article 10. As used herein, the expression "coating" refers generally to at least a single layer of flowable material, such as a liquid or a solid powder, that is applied directly to a surface. A coating, therefore, does not include a separate sheet of material laminated to a surface. As used herein, the expression "layer" refers generally to the non-slip material forming a discrete stratum on top of the backing layer 12 (i.e., the non-slip material does not soak through the entire thickness of the backing layer 12).

In one end use application of the invention, the sheet-like abrasive article 10 may be used for hand sanding a work surface, such as a wooden surface or work piece. That is, the abrasive article 10 may be used to remove material from a surface by contacting the abrasive article 10 directly with one's hand (i.e., without the aid of a tool, such as a sanding block) via the non-slip coating layer 14, and subsequently moving the abrasive article 10 against the work surface. It will be recognized that the present invention may also be used with manually-operated sanding tools and sanding blocks, or with power tools.

The backing layer 12, the non-slip coating layer 14, the adhesive make coat layer 16, and the abrasive particles 18 are each described in detail below.

Backing 12

Suitable materials for the backing layer 12 include any of the materials commonly used to make sandpaper including, for example, paper, cloths (cotton, polyester, rayon) polymeric films such as thermoplastic films, foams, and laminates thereof. The backing layer 12 will have sufficient strength for handling during processing, sufficient strength to be used for the intended end use application, and the ability to have the non-slip coating 14 and make coat 16 applied to at least one of its major surfaces.

In the illustrated embodiment, the backing layer 12 is formed of paper. Paper is a desirable material for the backing layer 12 because it is readily available and is typically low in cost. Conventional sandpaper, however, which has a paper backing layer, has limited durability, and has a smooth slippery surface that makes conventional sandpaper difficult to move over a work surface and, therefore, makes sanding difficult.

Paper backings are available in various weights, which are usually designated using letters ranging from "A" to "F". The letter "A" is used to designate the lightest weight papers, and the letter "F" is used to designate the heaviest weight papers. As explained more fully below, the present invention allows any weight paper to be used without experiencing the drawbacks associated with conventional sandpaper backings noted above.

In the illustrated embodiment, the backing layer 12 is continuous. That is, the backing layer 12 does not contain holes, openings, slits, voids, or channels extending there through in the Z-direction (i.e., the thickness or height dimension) that are larger than the randomly formed spaces between the material itself when it is made. The backing may also contain openings (i.e., be perforated), or contain slits. The backing layer 12 is also generally non-extensible. Non-extensible refers to a material having an elongation at break of typically no greater than about 25%, no greater than about 10%, or no greater than about 5%.

In certain embodiments, such as when the backing layer 12 is formed of paper, the backing layer 12 may be relatively thin, and typically has a thickness of no greater than about 1.5 mm, no greater than about 1 mm, or no greater than about 0.75 mm. In such embodiments, the backing layer 12 is generally not resilient. The backing layer 12 may also be porous or non-porous. In another embodiment, such as when the backing is a foam material, the backing layer may be somewhat thicker. For example, in embodiments having a foam backing layer, the backing layer may have a thickness of at least about 2 mm, at least about 5 mm, or at least about 10 mm.

The backing layer 12 may also be formed of a cloth material or film, such as a polymeric film. Cloth materials are desirable because they are generally tear resistant and are generally more durable than paper and film materials. In addition, cloth backings tolerate repeated bending and flexing during use. Cloth backings are generally formed of woven cotton or synthetic yarns that are treated to make them suitable for use as a coated abrasive backing. As is the case with paper backings, cloth backings are available in various weights, which are usually designated using a letter ranging from "J" to "M" with the letter "J" designating the lightest weight cloth, and the letter "M" designating the heaviest weight cloths.

Suitable film materials for the backing layer 12 include polymeric films, including primed films, such as polyolefin film (e.g., polypropylene including biaxially oriented polypropylene, polyester film, polyamide film, cellulose ester film).

Non-Slip Coating Layer 14

In accordance with one aspect of the invention, the sandpaper 10 includes a non-slip coating layer 14, which defines a non-slip, or slip resistant, outer surface 14*a* of the sandpaper 10. "Non-slip" or "slip resistant" coatings, layers, or materials refer to coatings, layers, or materials that tend to increase the coefficient of friction of the backing layer surface to which the non-slip material is applied. That is, if the surface of the backing layer 12*a* to which a non-slip coating layer is applied has a coefficient of friction of "x" prior to when the coating is applied, and the coating—as applied to the surface of the backing—provides a surface that has a coefficient of friction that is greater than "x", then the coating is a "non-slip" coating. Or stated another way, if the coating tends to increase the coefficient of friction of the backing surface to which it is applied, then the coating qualifies as a "non-slip" coating.

In one embodiment, the non-slip coating layer 14 has an average peak static coefficient of friction of at about 1 gram, at least about 1.25 grams, or at least about 1.5 grams when measured according to ASTM D 1894-08 (Standard Test Method for Static and Kinetic Coefficients of Friction of Plastic Film and Sheeting) at 23° C. using an IMASS slip/peel tester (SP2000, commercially available from Instrumentors Inc., Strongsville, Ohio), and/or an average kinetic coefficient of friction of at least about 0.75 grams, at least about 1 gram, or at least about 1.25 grams.

The non-slip coating layer 14 is provided on the first major surface 12*a* of the backing layer 12 opposite the make coat 16 and abrasive particles 18. The non-slip coating layer 14 outer surface 14*a* may have no tack, or have a low level of tackiness. Tack or tackiness as used herein refers to the stickiness or adhesive properties of a material. Non-tacky refers to a material that does not possess any degree of stickiness or adhesive properties, whereas tacky materials possess some degree of stickiness or adhesive properties. Non-tacky materials may possess a high coefficient of friction, therefore also making non-tacky materials useful as non-slip coatings.

If the non-slip coating is tacky, it is desirable that it have a low level of tackiness. By low level of tackiness, it is meant that the non-slip coating has an average tack level, as measured by ASTM D2979-88 (Standard Test Method for Tack of Pressure-Sensitive Adhesives Using an Inverted Probe Machine) using a ten (10) second dwell time, and a probe removal speed of one (1) cm/s, of no greater than about 200 grams, no greater than about 250 grams, no greater than about 300 grams, and no greater than about 350 grams. It is desirable that the material used to form the non-slip coating layer 14 bond directly to the backing layer 12. If the non-slip material does not form an effective bond with the backing layer, the backing layer 12 may be primed to allow the non-slip material to form a more effective bond with the backing layer 12.

In one embodiment, the non-slip coating 14 is slightly tacky, and has an adhesion to itself that is less than the cohesive strength of the non-slip coating itself, and further has an adhesion to itself that is less than the "two-bond" adhesive strength. As is known to those skilled in the art, the "two-bond" adhesive strength is the adhesive strength between the non-slip coating 14 and the backing layer 12 to which the non-slip coating layer is applied. Thus, when the non-slip coating 14 is folded over onto itself, the respective non-slip surfaces that come into contact can be released again without experiencing cohesive failure of the non-slip layers, and without having the non-slip layer 14 detaching from the backing layer 12.

In another aspect, the non-slip coating provides a surface that may be repeatably bonded to itself. In another somewhat related aspect, the non-slip coating 14 may be repositionable. As used herein, "repositionable" refers to a non-slip coating that allows repeated application, removal, and reapplication to and from itself or a surface without damage to the non-slip coating or the surface.

In addition, it is desirable that the adhesion of the non-slip coating layer 14 to itself not build significantly over time. As such, if the abrasive article 10 is folded over onto itself such that the non-slip coating layer 14 contacts itself, the abrasive article 10 may later be readily unfolded by separating the non-slip coating layers 14 without damaging the non-slip coating 14 or the backing layer 12.

Suitable materials for the non-slip coating layer 14 include, for example, elastomers. Suitable elastomers include: natural and synthetic rubbers such as synthetic polyisoprene, butyl rubbers, polybutadiene, styrene-butadiene rubber (SBR), block copolymers such as Kraton rubber, polystyrene-polyisoprene-polystyrene (SIS) rubber, styrene-butadiene-styrene (SBS) rubber, nitrile rubber (Buna-N rubbers), hydrogenated nitrile rubbers, acrylonitrile butadiene rubber (NBR), chloroprene rubber, polychloroprene, neoprene, EPM rubber (ethylene propylene rubber), EPDM rubber (ethylene propylene diene rubber), acrylic rubber, polyacrylic rubber, silicone rubber, ethylene-vinyl acetate (EVA), polyvinyl acetate (PVA), and other types of elastomers such as thermoplastic elastomers, thermoplastic vulcanizates such as Santoprene thermoplastic rubber, urethanes such as thermoplastic polyurethane, and thermoplastic olefins. Such rubber materials may further include a tackifying agent such as Wingtack Plus resin, available from Sartomer Company Inc., Exton, Pa. The tackiness of such elastomeric non-slip coating layers may be adjusted by adding fillers, such as calcium carbonate, to the material.

In one aspect, the non-slip coating layer may have a glass transition temperature of at least about −80 degrees Celsius (° C.), at least about −70° C., and at least about −65° C., and a glass transition temperature of no greater than about −5° C., no greater than about −15° C., and no greater than about −25° C. In a more specific aspect, the non-slip coating layer 14 is formed of an aqueous solution that forms a coating layer having a glass transition temperature of at least about −80 degrees Celsius (° C.), at least about −70° C., and at least about −65° C., and a glass transition temperature of no greater than about −5° C., no greater than about −15° C., and no greater than about −25° C.

Commercially available materials suitable for producing elastomeric non-slip coating layers include Butofan NS209, a carboxylated styrene-butadiene anionic dispersion available from BASF Corporation, Florham Park, N.J., and Hystretch elastomeric dispersions V-29, V-43, and V-60 available from Lubrizol Corporation, Wickliffe, Ohio. Ethylene-vinyl acetate (EVA) dispersion may also be used.

Suitable materials for producing the non-slip coating layer 14 also include acrylates and acrylic polymers. In addition, suitable materials for producing the non-slip coating layer 14 include pressure sensitive adhesives, such as acrylic adhesives—which may or may not include a tack modifying ingredient—repositionable adhesives, or hot melt acrylic adhesives. Depending on the particular composition, and depending on the degree of processing (for example, the degree of polymerization), such hot melt acrylic adhesives can be produced with a variety of physical characteristics including both tacky and non-tacky characteristics.

The particular thickness of the non-slip coating layer 14 may vary depending on, for example, the material selected to form the non-slip coating layer 14, and depending on the intended end use application for the abrasive article 10. For example, a non-slip coating layer 14 formed of rubber or urethane base material may have a thickness of at least about 0.1 mil (2.5 micrometers), at least about 1 mil (25 micrometers), and at least about 10 mils (254 micrometers), and a thickness of no greater than about 50 mils (1270 micrometers), no greater than about 30 mils (762 micrometers), and no greater than about 25 mils (635 micrometers). A non-slip coating layer 14 formed of an acrylic polymer coating, on the other hand, may be thinner, and may have a thickness of at least about 0.1 (2.5 micrometers), at least about 0.5 (12.7 micrometers), and at least about 1 mil (25.4 micrometers), and a thickness of no greater than about 2 mils (50.8 micrometers), no greater than about 5 mils (127 micrometers), and no greater than about 10 mils (254 micrometers).

A non-slip coating layer 14 formed from a dried styrene-butadiene rubber dispersion or a dried latex dispersion may have a coating weight of at least about 1 gram/square meter ($g/m^2$) (0.24 grains/24 square inch (grains/24 $in^2$)), at least about 3 $g/m^2$ (0.72 grains/24 $in^2$), or at least about 4 $g/m^2$ (0.96 grains/24 $in^2$), and a coating weight of no greater than about 20 $g/m^2$ (4.8 grains/24 $in^2$), no greater than about 15 $g/m^2$ (3.6 grains/24 $in^2$), or no greater than about 12 $g/m^2$ (2.9 grains/24 $in^2$).

In one embodiment, a suitable non-slip coating layer 14 may be produced using a pressure sensitive adhesive by coating a polymerizable pressure sensitive adhesive composition onto the backing layer 12, and then polymerizing the pressure sensitive adhesive composition to produce a non-slip coating layer having the desired properties, or by coating a repositionable pressure sensitive adhesive onto the backing layer 12.

In a specific embodiment, the pressure sensitive adhesive is an acrylic hot melt adhesive that may be produced by, for example, providing a polymerizable liquid monomer mixture in a sealed pouch formed of, for example, ethylene vinyl acetate (EVA), at least partially polymerizing the liquid monomer mixture by, for example, exposing the liquid monomer mixture to actinic radiation (e.g., ultraviolet light), blending the partially polymerized liquid with the EVA material used to form the pouch, thereby forming a coatable pressure sensitive adhesive composition, and coating the pressure sensitive adhesive composition onto a backing layer 12. After the pressure sensitive adhesive composition has been coated onto the backing layer 12, the non-slip layer 14 is formed by further polymerizing the pressure sensitive adhesive to form a non-slip coating layer having the desired characteristics, such as a coating layer having a low level of tack, or no tack.

The degree of additional polymerization may vary, and will depend, for example, on the desired properties of the non-slip layer 14. Further polymerization may be accomplished by, for example, exposing the pressure sensitive adhesive to additional UV light or by thermal polymerization in an amount sufficient to reduce the level of tack of the pressure sensitive adhesive to the desired level.

A suitable polymerizable liquid monomer mixture may include, for example, a mixture of 2 ethyl hexyl acrylate, butyl acrylate, methyl acrylate, and a photo-initiator such as Irgacure 651 available from Ciba-Geigy Corp. Hawthorne, N.Y. Optional additives such as isooctyl thioglycolate, hexanediol diacrylate, alphabenzophenone, and Irganox 1076 antioxidant available from Ciba Specialty Chemicals Corporation, Tarrytown, N.Y., may also be included in the polymerizable liquid monomer mixture.

The non-slip coating layer 14 is typically applied as a liquid suspension, such as an aqueous dispersion, an aqueous emulsion such as a latex, or as a hot melt adhesive.

Liquids may be applied using a variety of known printing and/or coating techniques including, for example, roll coating (e.g., rotogravure coating), transfer roll coating, solvent coating, hot melt coating, Meyer rod coating, and drop die coating. Particularly desirable techniques for applying aqueous emulsions and dispersions include Meyer rod coating, rotogravure and transfer roll coating techniques. Such aqueous emulsions and dispersions are then allowed to dry to produce the non-slip coating layer 14. A particularly desirable technique for applying a hot melt adhesive, such as an acrylate hot melt adhesive, is drop die coating. Such a hot melt coated adhesive is then further polymerized to produce a non-slip coating layer 14 having the desired characteristics.

In one embodiment, the non-slip coating layer 14 is provided with a surface texture. Such a textured surface may be provided by applying the liquid emulsion or liquid dispersion to the backing layer 12 using, for example, a microcell foam roller. In a particular embodiment, a liquid emulsion or liquid dispersion is applied using a microcell foam roller to a coating weight of about 3 grains/24 square inch. The liquid coating may then be dried, for example, in a forced air oven at a temperature of 225 degrees Fahrenheit for 5 minutes to produce the non-slip coating layer.

In the embodiment illustrated in FIG. 1, the non-slip coating 14 defines a generally planer outer surface 14*a* of the sandpaper 10 opposite the make coat 16 and abrasive particles 18. That is, the non-slip coating layer 14 defines a smooth outer surface that does not include a textured surface or a macroscopic three dimensional surface topography. The coating layer 14 may be continuous, discontinuous, and/or applied in random or repeating patterns, such as dots and stripes.

In one embodiment, the non-slip coating layer 14 may be clear. In this manner, any information or indicia printed on the backing 12 will remain visible through the non-slip coating layer 14. In addition, the appearance of the sandpaper remains similar to the appearance of conventional sandpaper, to which users have become accustomed.

Figure 2:
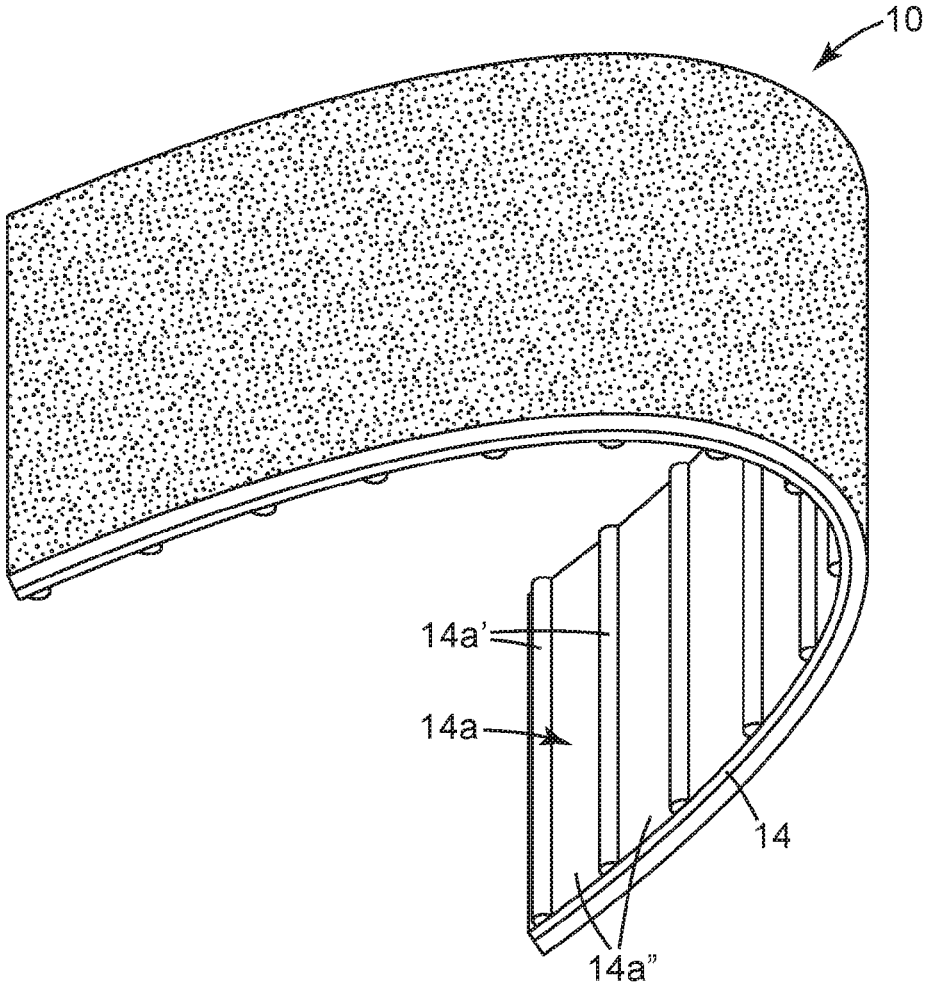
FIG. 2 is a perspective view of a second embodiment of the invention.

As illustrated in FIG. 2, the outer surface 14*a* of the non-slip coating layer 14 may include a regular patterned surface texture or geometry. In the specific embodiment illustrated, the patterned surface texture of the non-slip coating layer 14 outer surface 14*a* may be such that the pattern inter-engages with itself when the sandpaper 10 of folded over onto itself. That is, the outer surface 14*a* includes raised 14*a*' and recessed 14*a*" regions that mate with each other when the outer surface 14*a* is folded over onto itself.

In either of the embodiments shown in FIG. 1 or 2, the non-slip coating layer 14 may further comprise filler material or particles to provide the non-slip coating layer 14 outer surface 14*a* with a rough or randomly textured surface. Such a rough or textured surface serves to enhance the traction properties of the non-slip coating layer 14.

Make Coat 16

In general, any adhesive make coat 16 may be used to adhere the abrasive particles 18 to the backing layer 12. "Make coat" refers to the layer of hardened resin over the backing layer 12 of the sandpaper 10. Suitable materials for the adhesive make coat 16 include, for example, phenolic resins, aminoplast resins having pendant $\alpha,\beta$-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorene-modified epoxy resins, and combinations thereof.

The make coat 16 may be coated onto the backing layer 12 by any conventional technique, such as knife coating, spray coating, roll coating, rotogravure coating, curtain coating, and the like. The sandpaper 10 may also include an optional size coat (not shown).

Abrasive Particles 18

In general, any abrasive particles 18 may be used with this invention. Suitable abrasive particles include, for example, fused aluminum oxide, heat treated aluminum oxide, alumina-based ceramics, silicon carbide, zirconia, alumina-zirconia, garnet, emery, diamond, ceria, cubic boron nitride, ground glass, quartz, titanium diboride, sol gel abrasives and combinations thereof. The abrasive particles 18 can be either shaped (e.g., rod, triangle, or pyramid) or unshaped (i.e., irregular). The term "abrasive particle" encompasses abrasive grains, agglomerates, or multi-grain abrasive granules. The abrasive particles can be deposited onto the make coat 16 by any conventional technique such as electrostatic coating or drop coating.

Additives

The make coat 16 and/or the optional size coat may contain optional additives, such as fillers, fibers, lubricants, grinding aids, wetting agents, thickening agents, anti-loading agents, surfactants, pigments, dyes, coupling agents, photo-initiators, plasticizers, suspending agents, antistatic agents, and the like. Possible fillers include calcium carbonate, calcium oxide, calcium metasilicate, alumina trihydrate, cryolite, magnesia, kaolin, quartz, and glass. Fillers that can function as grinding aids include cryolite, potassium fluoroborate, feldspar, and sulfur. The amounts of these materials are selected to provide the properties desired, as is known to those skilled in the art.

In a specific embodiment, the sandpaper 10 is a standard 9×11 inch sheet of sandpaper. In other embodiments, the sandpaper 10 may have a width of about 3 to about 4 inches, or of about 5 to about 6 inches, and a length of about 8 to about 10 inches, or about 10 to about 12 inches.

In another aspect, the present invention provides a package of sandpaper including a stack of sheets of sandpaper. The stack may include at least 2 sheets, at least about 6 sheets, or at least about 10 sheets.

Methods of Making

The various embodiments described above may be made using a variety of techniques, and will vary depending on the particular material used to produce the non-slip coating layer 14. For example, the abrasive article 10 may be made by providing a paper backing layer, coating an adhesive make coat on one major surface of the backing layer, at least partially embedding abrasive particles in the make coat, thereby forming an abrasive surface, dissolving a non-slip coating material, such as a mixture of rubber and tackifier, in a hydrocarbon solvent, such as toluene, thereby to form a coatable non-slip material, coating the non-slip material and solvent onto the surface of the backing layer opposite the make coat, and allowing the solvent to evaporate from the non-slip material, thereby forming a non-slip coating layer 14 on the backing layer 12. Using this technique, the non-slip coating layer 14 is said to be "solvent coated" onto the backing.

In another method of making the abrasive article 10, an aqueous emulsion or aqueous dispersion is coated onto the backing layer 12 opposite the make coat 16, and is dried, thereby forming the non-slip coating layer 14.

Alternatively, the abrasive article 10 may be made by providing a paper backing layer 12, coating an adhesive make coat 16 on one major surface of the backing layer 12, at least partially embedding abrasive particles 18 in the adhesive make coat 16, thereby forming an abrasive surface, providing a non-slip material such as a mixture of rubber and tackifier, heating the non-slip material, thereby forming a coatable non-slip material, and coating the non-slip material onto the surface of the backing layer 12 opposite the make coat 16, thereby forming a non-slip coating layer 14. With this technique, the non-slip coating layer 14 may be coated onto the backing layer 12 using, for example, roll coating, hot melt coating, or drop die coating techniques.

In one embodiment, the roller used to apply the coatable non-slip material is a foam roller, which imparts a surface texture to the non-slip coating layer. Alternatively, a foam roller may be used to post treat the non-slip coating layer 14 after it has been coated onto the backing layer 12, thereby imparting the non-slip coating layer with a surface texture.

In another method of making the abrasive article 10, an adhesive, such as an acrylic hot melt adhesive, is coated onto the backing layer 12 opposite the make coat 16, and is cured by, for example, polymerization or drying, thereby forming the non-slip coating layer 14.

In any of the above techniques, it will be recognized that the order in which the non-slip coating layer 14 and made coat layer 16 are applied to the backing layer 12 may be varied. That is, the non-slip coating layer 14 may be applied to the backing layer 12 either before or after the make coat 16 is applied to the backing layer 12.

In addition, it will be recognized that the backing layer 12, make coat 16, and abrasive particles 18 may be provided in the form of a pre-formed (i.e., otherwise complete) abrasive sheet. That is, rather than providing a backing layer 12, which is then coated with make coat 16 and provided with abrasive particles 18 to form an abrasive sheet, a pre-formed abrasive sheet including a backing, make coat and abrasive particles may be provided. The non-slip coating layer 14 can then be applied directly to the pre-formed abrasive sheet.

Representative examples of suitable pre-formed abrasive sheets are available under the product designation 216U, from 3M Company, St. Paul, Minn. 216U is sandpaper having an A weight backing, a phenolic make coat, aluminum oxide abrasive particles, and a stearic acid supersize coating, which is provided to minimize loading. If a pre-formed abrasive sheet is used, the non-slip coating layer 14 may be applied to the backing layer 12 using, for example, solvent coating, roll coating, hot melt coating, drop die, or powder coating techniques. For ease of manufacturing, it is desirable to provide the finished sandpaper in bulk form, and then coat the bulk sandpaper with the non-slip coating material prior to producing the individual sheets of sandpaper that are ultimately used by the end user.

A wide variety of commercially available conventional sandpaper constructions having a wide variety of backing materials (e.g., papers, films, cloths), weights (e.g., A, B, or C weight paper), and abrasive particles may be coated with a non-slip coating according to the present invention.

In order that the invention described herein can be more fully understood, the following examples are set forth. It should be understood that these examples are for illustrative purposes only, and are not to be construed as limiting this invention in any manner.

EXAMPLES

In each of the Examples set forth below, commercially available sandpaper sold by 3M Company, St. Paul, Minn., under the product designation "216U P150 Production RN Paper A Weight, Open Coat, Fre-Cut" was used to make an abrasive article 10 having the construction shown in FIG. 1. 216U sandpaper is a general purpose sandpaper having an A-weight paper backing, a phenolic resin coated on one side, and aluminum oxide abrasive particles at least partially embedded in the phenolic resin. The second side (i.e., the non-abrasive side opposite the abrasive surface) of the sandpaper was then coated with one of the non-slip coating layers described below.

For each of Examples 1-8, the resulting non-slip coating layer 14 had a low level of tack that allowed the non-slip coating layer 14 to be folded over onto itself, and allowed the contacting surfaces to be readily separated without damaging either of the non-slip coating layer 14 surfaces, and without damaging or separating from the underlying backing 12.

For each of Examples 2-8, as well as for two comparative examples—one of standard 216U sandpaper (i.e., without a non-slip layer applied to the second side of the backing), and one of standard 3M Wet or Dry Sandpaper, the average peak static coefficient of friction and average kinetic coefficient of friction was measured three times according to the test method set forth in ASTM D 1894-08 (Standard Test Method for Static and Kinetic Coefficients of Friction of Plastic Film and Sheeting) at 23° C. using an IMASS slip/peel tester (SP2000, commercially available from Instrumentors Inc., Strongsville, Ohio). The average results of the three measurements are presented in Table 1 below.

Comparative Example A

Comparative Example A was 3M grade P150 216U Production RN, Paper A Weight, Open Coat, Fre-Cut sandpaper commercially available from 3M Company, St. Paul, Minn.

Comparative Example B

Comparative Example B was grade P320 213Q Imperial Wetordry Production Paper A Weight paper sheet also available from 3M Company.

Example 1

Example 1 was 216U sandpaper wherein the second side was coated with a blend of 90% by weight Kraton D-1161K SIS block copolymer sold by Kraton Polymers, LLC of Houston, Tex., and 10% by weight Wingtack Plus tackifier sold by Sartomer Company Inc. of Exton, Pa., dissolved in toluene, such that the resulting solution was about 40% by weight solids. The blend was coated onto the backing layer 12 to a thickness of 1.5 mils using a knife coater, and was allowed to dry at ambient conditions to allow the toluene to completely evaporate. The average coefficient of friction for Example 1 was not measured and is, therefore, not included in Table 1.

Example 2

Example 2 was 216U sandpaper wherein the second side was coated with an acrylic hot melt adhesive produced by first partially polymerizing a liquid monomer mixture in an ethylene-vinyl acetate (EVA) pouch by exposing it to UV light. The liquid monomer mixture included 14% by weight 2-ethyl hexyl acrylate, 42% by weight butyl acrylate, 44% by weight methyl acrylate, and further included the following additives (in parts per hundred additives—ppha): 0.17 ppha Irgacure 651 photo-initiator sold by Ciba-Geigy Corporation of Hawthorne, N.Y., 0.06 ppha isooctyl thioglycolate, 0.004 ppha hexanediol diacrylate, 0.092 ppha alphabenzophenone, and 0.4 ppha Irganox 1076 antioxidant sold by Ciba Specialty Chemicals Corporation of Tarrytown, N.Y. The partially polymerized monomer mixture was then blended with the EVA pouch using a twin screw extruder, such that the partially polymerized monomer mixture blend also included 4 ppha ethylene-vinyl acetate (EVA). The partially polymerized pressure sensitive adhesive was then coated onto the backing layer 12 using a drop die coater to a thickness of about 1.5 mils. The partially polymerized pressure sensitive adhesive coated onto the backing layer 12 was then further polymerized by exposing the adhesive to UV light.

Example 3

Example 3 was 216U sandpaper wherein the second side was coated with Silastic High Consistency Silicone Rubber available from Dow Corning, Midland, Mich. The Silastic silicone rubber was coated on the backing layer 12 to a thickness of 1.5 mils using a knife coater, and was cured at room temperature for 24 hours.

Example 4

Example 4 was 216U sandpaper wherein the second side was coated with Butofan NS 209 carboxylated styrene-butadiene anionic dispersion available from BASF using a #50 Meyer rod at a coating weight of approximately 3 grains/24 in$^2$, and then dried in a forced air oven at 225° F. for 5 minutes.

Example 5

Example 5 was the same as Example 4 except the non-slip coating layer of Butofan NS 209 was coated at a weight of approximately 9 grains/24 in$^2$.

Example 6

Example 6 was 216U sandpaper wherein the second side was coated with Hystretch V-29 elastomeric emulsion available from Lubrizol using a #9 Meyer rod at a coating weight of approximately 2.5 grains/24 in$^2$, and then dried in a forced air oven at 225° F. for 5 minutes.

Example 7

Example 7 was 216U sandpaper wherein the second side was coated with Hystretch V-43 elastomeric emulsion available from Lubrizol using a #9 Meyer rod at a coating weight of approximately 2.5 grains/24 in$^2$, and then dried in a forced air oven at 225° F. for 5 minutes.

Example 8

Example 8 was 216U sandpaper wherein the second side was coated with Hystretch V-60 elastomeric emulsion available from Lubrizol using a #9 Meyer rod at a coating weight of approximately 2.5 grains/24 in$^2$, and then dried in a forced air oven at 225° F. for 5 minutes.

TABLE 1

| | Average Coefficient of Friction | |
|---|---|---|
| Example | Static (grams) | Kinetic (grams) |
| Comparative A (216U) | 0.52 | 0.28 |
| Comparative B (Wet or Dry) | 0.90 | 0.66 |
| 2 (TDX) | 4.79 | 4.58 |
| 3 (Silicone) | 2.83 | 2.53 |
| 4 (Butofan 1) | 2.91 | 1.32 |
| 5 (Butofan 2) | 5.21 | 2.10 |
| 6 (V-29) | 1.78 | 2.03 |
| 7 (V-43) | 1.49 | 1.64 |
| 8 (V-60) | 1.91 | 1.57 |

Persons of ordinary skill in the art may appreciate that various changes and modifications may be made to the invention described above without deviating from the inventive concept. Thus, the scope of the present invention should not be limited to the structures described in this application, but only by the structures described by the language of the claims and the equivalents of those structures.

What is claimed is:

1. A sheet of sandpaper comprising:

a backing layer having opposed first and second major surfaces, an adhesive make coat directly on the first major surface, abrasive particles at least partially embedded in the make coat, thereby defining an abrasive surface, and a non-slip layer on the second major surface, the non-slip layer having a rough or randomly textured surface and configured to selectively fold over onto itself, bond to itself, and release from itself such that, when bonded to itself, the non-slip coating layer has an adhesion level that is less than a cohesive strength of the non-slip coating layer, whereby the non-slip coating layer is not damaged when the non-slip coating layer is separated from itself.

2. The sheet of sandpaper of claim 1, wherein the non-slip layer includes an elastomer.

3. The sheet of sandpaper of claim 1, wherein the non-slip layer is non-tacky.

4. The sheet of sandpaper of claim 1, wherein the non-slip layer is tacky.

5. The sheet of sandpaper of claim 1, wherein the non-slip layer comprises a material selected from the group consisting of natural rubber, synthetic rubber, ethylene-vinyl acetate (EVA), polyvinyl acetate (PVA), thermoplastic vulcanizates, acrylates, acrylic polymers, thermoplastic olefins, and combinations thereof.

6. The sheet of sandpaper of claim 5, wherein the synthetic rubber is selected from the group consisting of styrene-butadiene rubber (SBR), ethylene-propylene terpolymers (EPDM rubber), silicone rubber, and polyurethane rubber.

7. The sheet of sandpaper of claim 1, wherein the non-slip layer has a glass transition temperature in the range of about −25° C. to about −65° C.

8. The sheet of sandpaper of claim 7, wherein the non-slip layer comprises an acrylic polymer coating.

9. The sheet of sandpaper of claim 8, wherein the non-slip layer has an average tack level, as measured by ASTM D2979-88 using a 10 second dwell time, and a probe removal speed of 1 cm/s of no greater than about 300 grams.

10. The sheet of sandpaper of claim 1, wherein the non-slip layer is configured to selectively fold over onto itself, bond to itself, and release from itself such that, when bonded to itself, the non-slip coating layer has an adhesion that is less than a two-bond adhesion of the non-slip coating layer to the backing layer, whereby the non-slip coating layer does not separate from the backing layer when the non-slip coating layer is separated from itself.

11. The sheet of sandpaper of claim 1, wherein the non-slip layer has a thickness of between at least about 0.2 mils and no greater than about 50 mils.

12. The sheet of sandpaper of claim 1, wherein the non-slip layer has a coating weight of at least about 4 $g/m^2$ and no greater than about 20 $g/m^2$.

13. The sheet of sandpaper of claim 1, wherein the non-slip layer comprises a continuous uniform outer surface opposite the abrasive particles.

14. The sheet of sandpaper of claim 1, wherein the non-slip layer has an average peak static coefficient of friction of at least about 1 gram when measured according to ASTM D 1894-08.

15. The sheet of sandpaper of claim 1, wherein the non-slip layer has an average kinetic coefficient of friction of at least about 0.75 grams when measured according to ASTM D 1894-08.

16. The sheet of sandpaper of claim 1, wherein the work surface comprises wood.

17. The sheet of sandpaper of claim 1, wherein the non-slip layer includes filler material or particles.

* * * * *